US005209688A

United States Patent [19]

Nishigaki et al.

[11] Patent Number: 5,209,688

[45] Date of Patent: May 11, 1993

[54] PLASMA DISPLAY PANEL

[75] Inventors: Susumu Nishigaki; Syozo Ohtomo; Rikiya Kamimura; Kazunari Tanaka, all of Nagoya, Japan

[73] Assignee: Narumi China Corporation, Aichi, Japan

[21] Appl. No.: 672,765

[22] Filed: Mar. 20, 1991

Related U.S. Application Data

[62] Division of Ser. No. 451,335, Dec. 15, 1989, abandoned.

[30] Foreign Application Priority Data

Dec. 19, 1988 [JP] Japan ..... 63-321590
Dec. 19, 1988 [JP] Japan ..... 63-321591
Dec. 19, 1988 [JP] Japan ..... 63-321592
Feb. 22, 1989 [JP] Japan ..... 1-42790

[51] Int. Cl.[5] ..... H01J 9/02

[52] U.S. Cl. ..... 445/24; 445/49; 430/315

[58] Field of Search ..... 445/24, 49; 430/315, 430/198

[56] References Cited

U.S. PATENT DOCUMENTS 4,047,169 9/1977 Holz ..... 313/584
4,088,490 5/1978 Duke et al. ..... 430/315
4,344,817 9/1982 Chamberlin ..... 445/24
4,416,974 11/1983 Scheve ..... 430/198
4,598,037 7/1986 Felten ..... 430/198
4,599,076 7/1986 Yokono et al. ..... 313/355
4,600,397 7/1986 Kawakubo et al. ..... 313/355
4,828,961 5/1989 Lau et al. ..... 430/198

FOREIGN PATENT DOCUMENTS 58-188030 11/1983 Japan ..... 445/24

*Primary Examiner*—Richard K. Seidel
*Assistant Examiner*—Jeffrey T. Knapp
*Attorney, Agent, or Firm*—Flynn, Thiel, Boutell & Tanis

[57] ABSTRACT

A plasma display panel is disclosed, which comprises a pair of insulating substrates with a predetermined space therebetween; a group of anode electrodes and a group of cathode electrodes formed on the inner side of each of the insulating substrates in such a manner that the groups of the electrodes are normal to each other; and barriers formed on the insulating substrate having the anode electrodes thereon by photolithography. Since the barriers are formed by photolithography using an ultraviolet-curable resin or positive-type resist, high precision patterns having a line width of 100 μm or less and a line spacing of 100 μm or less can be easily obtained and, thereby, a high resolution plasma display having a decreased picture element area and a wider discharge space can be obtained. When photolithography is used in the formation of the cathode electrodes, further high precision fine patterns can be obtained and further finely detailed pitch of picture elements can be achieved.

15 Claims, 8 Drawing Sheets

PLASMA DISPLAY PANEL

This application is a division of U.S. Ser. No. 07/451,335, now abandoned, filed Dec. 15, 1989.

BACKGROUND OF THE INVENTION

1. Field of the Invention

The present invention relates to a plasma display panel (PDP), and in particular, to a plasma display panel which can be easily constructed with a finely detailed pitch of picture elements which is essential to provide numerous picture elements with a fine resolution and which can be used as a large-sized display panel.

2. Description of the Prior Art

The basic structure of a plasma display panel, as shown in FIG. 1, comprises a front substrate 1, on which anode electrodes 3 are formed; a back substrate 2 on which cathode electrodes 4 are formed; and barriers 5 disposed between the foregoing insulating substrates. Namely, the plasma display panel is constituted of a group of cathode electrodes and a group of anode electrodes, disposed perpendicular to one another, and the black barriers (5) which are disposed between the two groups of the electrodes so as to prevent cross-talk of light between the electrodes and provide sharply-defined pictures. A rare gas is enclosed within the electrodes and each intersection of the electrodes formed between the upper and lower substrates corresponds to one picture element. A voltage of 100V or greater is applied between the two electrodes and the gas is caused to undergo a glow discharge. The light generated in the glow discharge is used to form the display. The barriers have a configuration of about 100 μmm in width and at least 100 μm in height and, in display panels of A4 size, about 640 barriers are formed. Conventionally, these barriers have been formed by forming a pattern using a paste mixture consisting of ceramic powder, organic binder and solvent, etc., by a thick printing process, drying and firing. Also, cathode electrodes have been formed by printing a paste of a mixture consisting of electrode powder, organic binder and solvent, etc.

However, the conventional barriers have the following types of problems.

(1) The conventional barriers have been formed by the thick film printing in which the thickness obtained by one printing operation is at most ten-odd microns and the printing process should be repeated at least about ten times until the required height of at least 100 μmm is obtained. Therefore, alignment in each printing operation is very difficult and the yield of the resultant product is low.

(2) Since the conventional barriers have been fabricated by repetition of the thick film printing, both the minimum line width and the narrowest spacing between the barriers are on the order of about 100 μmm.

Further, referring to the shape of the barriers in the vertical direction, the ratio of the half-width to the base width (line width at the half-height of the barrier to the line width at the base of each barrier) is on the order of 0.5. This is disadvantageous in achieving very fine resolution. When the plasma display panel is used for a color picture, fluorescent materials of the three primary colors, i.e., red, green, and blue are applied between the barriers. Because the three primary color sections become one picture element, coarse pictures having a picture element of about 600 μmm square are produced.

(3) Since the barriers are produced by a thick film printing method using a stainless screen, the printed area is limited by the size of the screen. It is therefore very difficult to obtain a large-sized display of greater than A4 size. Therefore, a new method of forming barriers has been demanded.

Also, in a plasma display, when the electric discharge occurs within the electric discharge space, the atoms of gas are excited by electrons, and light is produced when these excited atoms revert to the ground state. The life span of the atoms in the excited state is about $10^{-8}$ sec, but there are also specific atoms which have a life span of the order of 1 to 10 msec. The latter atoms are slowly diffused throughout the electric discharge, collide with the structural material such as the barriers and the like and recombine. Then, the atoms disappear. The excited atoms with a long life expectancy are easily ionized when they collide with electrons, producing ionized electrons. Therefore, the greater the number of such excited atoms in the space, the more easily the ionization takes place. This stabilizes the discharge with the effect that the discharge voltage is reduced.

Also, the more space used for the discharge, the more advantageously the ionization takes place. Therefore, the discharge space has been expected to be increased by reducing the area per picture element.

SUMMARY OF THE INVENTION

It is therefore a first object of the present invention to provide a plasma display panel which can be easily constructed with a finely detailed pitch of picture elements which is essential to provide high resolution and highly fine color pictures and can meet the need for an expected large-sized display.

A second object of the present invention is to provide a panel for a plasma display wherein the area per picture element is reduced and thereby a wider electric discharge space can be ensured.

A third object of the present invention is to provide barriers having a fine pattern not exceeding 100 μmm both in the barrier line width and line spacing.

A fourth object of the present invention is to provide barriers wherein the ratio of the half-width to the base width (width at the half-height/to the width at the base) ranges from 0.8 to 1.2.

The present inventors have formed barriers and, if required, also cathode electrodes, by photolithography instead of the conventional printing process.

According to the present invention, a plasma display panel comprises a pair of insulating substrates with a predetermined space therebetween; a group of anode electrodes and a group of cathode electrodes formed on the inner side of each of the insulating substrates in such a manner that the groups of the electrodes are normal to each other; and barriers formed by photolithography on the insulating substrate which has the anode electrodes thereon.

Photolithography is a method of forming patterns in which a photosensitive material is applied onto a substrate and a mask is provided for shielding the applied material in a pattern-like form from the irradiation of an energy beam. An energy beam passing through the shielding mask is projected onto the photosensitive material, thereby forming a pattern. In comparison with the conventional printing method, since the pattern formation of the present invention is performed by techniques using light, it permits pattern line widths as fine as several tens of microns and line spacings of the order of several tens of microns, thereby providing patterns having a very high precision and resolution.

More specifically, the lithography process makes possible the attainment of plasma display panels having a line width of not more than 100 μmm, line spacing of not more than 100 μmm and barrier height of at least 100 μm. When this photolithography is applied in the formation of cathode electrodes, it permits the production of electrodes with line widths of 100 μmm or less and further finely detailed pitch of picture elements can be achieved. Further, the ratio of half-width to base width of the printing method is about 0.5, whereas that of the lithography method of the present invention can provide the ratio of 0.8 to 1.2.

Also, barriers and electrodes having an aspect ratio (height/base width) of at least 1 can be easily obtained by the above-mentioned photolithography.

Photolithography is classified into two types, i.e., a method using ultraviolet-curable resin and a method using a positive-type resist. In the method using an ultraviolet-curable resin, the ultraviolet-curable resin is cross-linked by irradiation with ultraviolet light and becomes insoluble in solvent. On the other hand, in the method using a positive-type resist, the resist is subjected to chemical change in molecules thereof when exposed to ultraviolet light and thereby becomes soluble in alkali. Both methods may be used to form barriers and electrodes of the present invention.

When an ultraviolet-curable resin is used, the barriers of the present invention are formed by a photolithography process using an ultraviolet-curable resin, the comprising the steps of:

(1) applying a slip comprising an ultraviolet-curable resin and ceramic powder for forming the barrier onto the insulating substrate or the insulating substrate having electrodes thereon, thereby forming a coating layer;

(2) exposing the coating layer to ultraviolet light through a mask in such a pattern as to correspond to a pattern of the barriers and thereby curing the ultraviolet-curable resin;

(3) repeating the steps (1) and (2) once or several times until the thickness of the coating layer becomes the desired thickness;

(4) developing the exposed portions of the coating layer and leaving the same, thereby forming the pattern of the barriers; and (5) firing the exposed portions to form the barriers.

As will be noted from the above formation procedure, when an ultraviolet-curable resin is used, the height of the barriers may be changed in the above step (3) as required. This is advantageous in color plasma display panels. In such color plasma display panels, when low barriers formed between the three primary color sections of red, green and blue of each picture element and high barriers are formed every picture element including the three primary color sections, an area per picture element is reduced and a wider discharge space can be ensured.

When a positive-type resist is employed, the barriers of the plasma display panel are formed by a photolithography process using a positive-type resist, the photolithography process comprising the steps of:

(1) forming a positive-type resist layer having a thickness equal to or greater than the thickness of the barriers to be formed on the insulating substrate or the insulating substrate having electrodes;

(2) exposing the positive-type resist layer to ultraviolet light through a mask in such a pattern as to correspond to a pattern of the barriers, (3) developing and eluting the exposed portions, thereby forming opening portions corresponding to the pattern of the barriers, (4) exposing the remaining positive-type resist layer to ultraviolet light to make the remaining positive-type resist layer soluble in a developing solution;

(5) filling an insulating paste comprising ceramic powder for forming the barriers in the opening portions;

(6) eluting the remaining positive-type resist layer with a developing solution; and (7) firing the insulating paste to form the barriers.

Although the cathode electrode of the present invention may be formed by a screen printing method, photolithography allows the formation of more sharply-defined images. The formation of the electrodes using an ultraviolet-curable resin or a positive-type resist is basically the same as the formation of the barriers except that an electrode material is used in place of the ceramic powder or the insulating paste used for the barrier formation and the thickness of the electrodes is lower than that of the barriers.

BRIEF DESCRIPTION OF THE DRAWINGS

FIGS. 3(*h*) and (*i*) are cross-sectional views of masks for forming barriers having different heights.

FIG. 3(*j*) is a cross-sectional view showing the main part of the plasma display panel of the present invention.

DETAILED DESCRIPTION OF THE PREFERRED EMBODIMENTS

Figure 1:
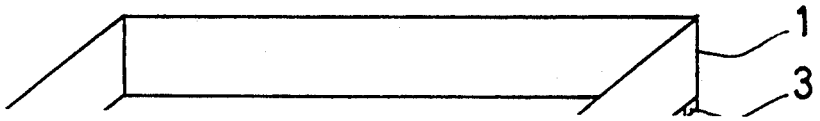
FIG. 1 is a perspective schematic illustration of the basic structure unit of a plasma display.
Figure 1:
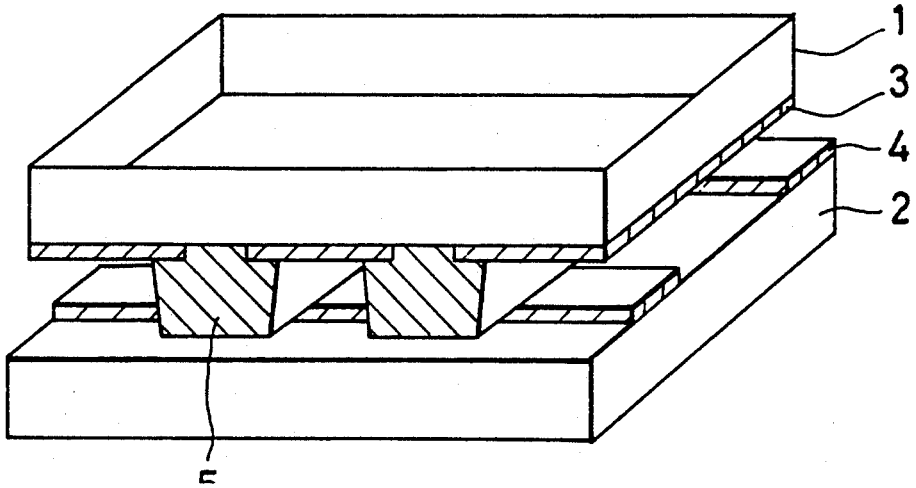
Figure 2A:
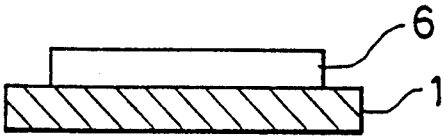
FIGS. 2(*a*)–(*e*) are cross-sectional views illustrating the process for forming barriers using an ultraviolet-curable resin.
Figure 2B:
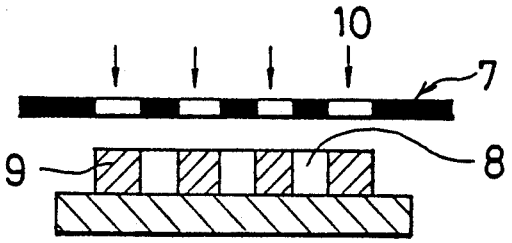
Figure 2C:
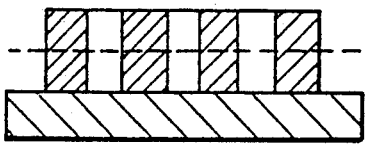
Figure 2D:
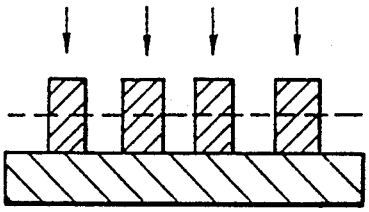
Figure 2E:
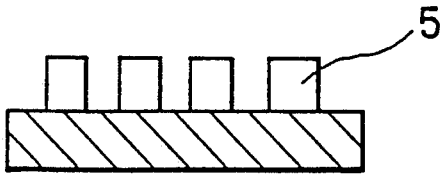
Figure 3A:
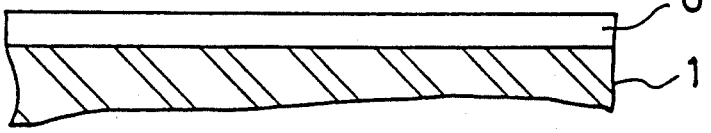
FIGS. 3(*a*)–(*g*) are cross-sectional views illustrating the process for forming barriers having different heights, using an ultraviolet-curable resin.
Figure 3B:
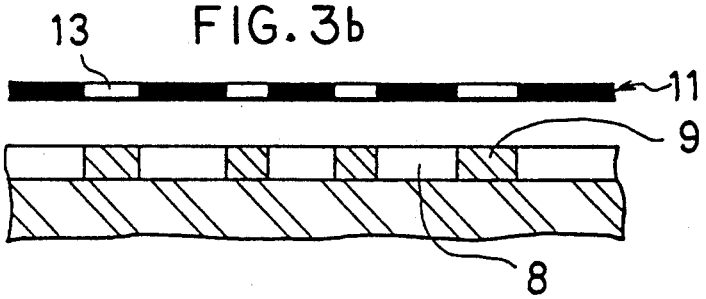
Figure 3C:
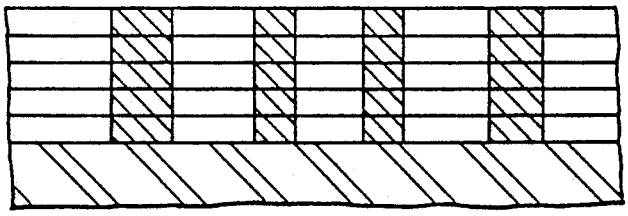
Figure 3D:
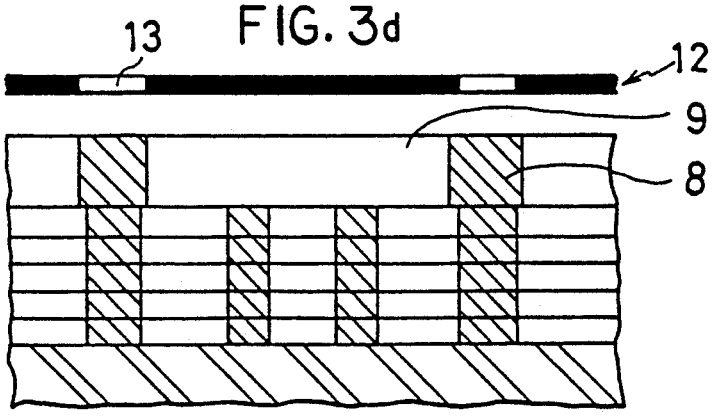
Figure 3E:
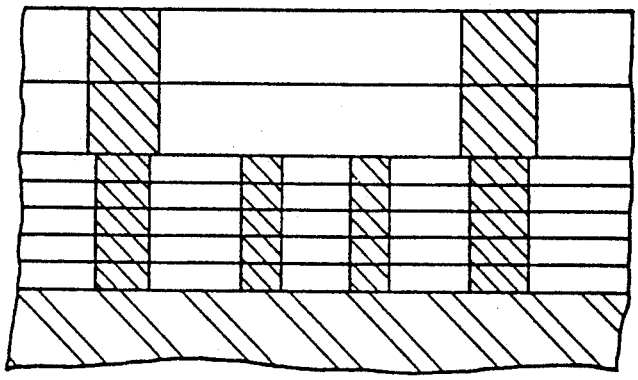
Figure 3F:
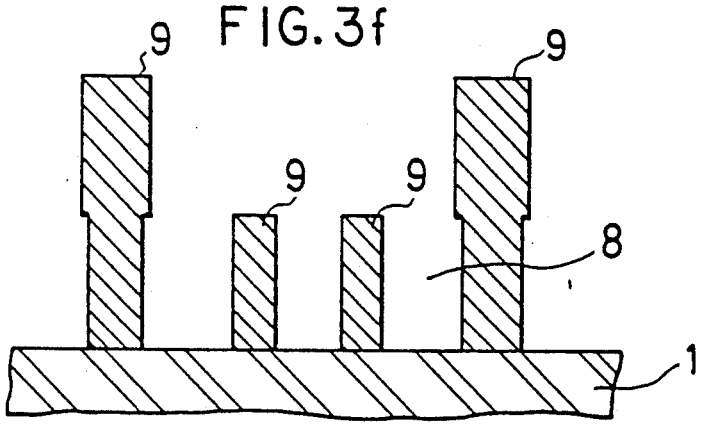
Figure 3G:
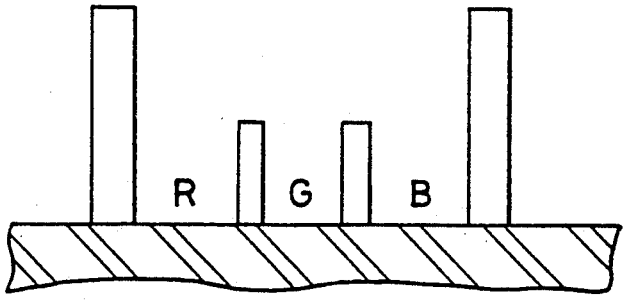
Figure 3H:
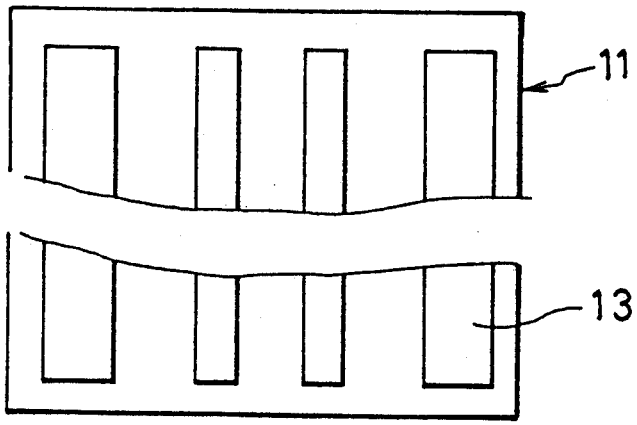
Figure 3I:
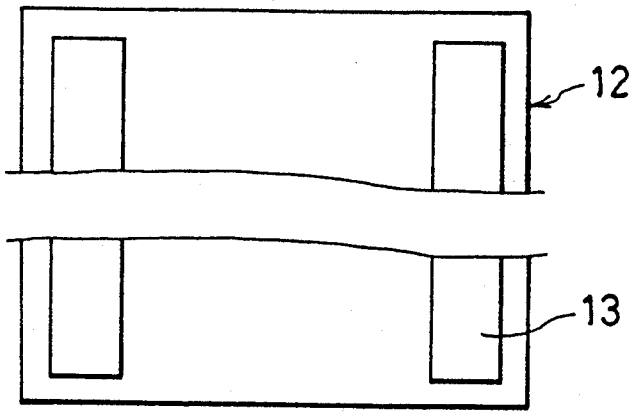
Figure 3J:
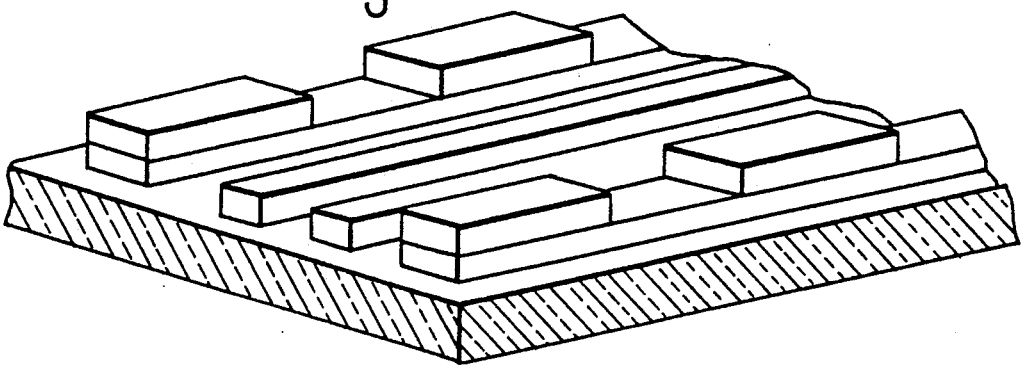
Figure 4A:
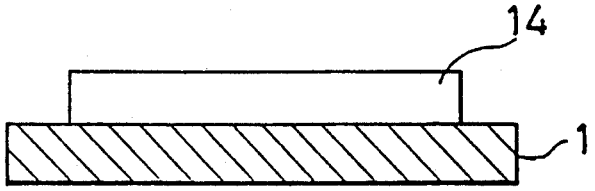
FIGS. 4(*a*)–(*g*) are cross-sectional views showing the process for forming barriers using a positive-type resist.
Figure 4B:
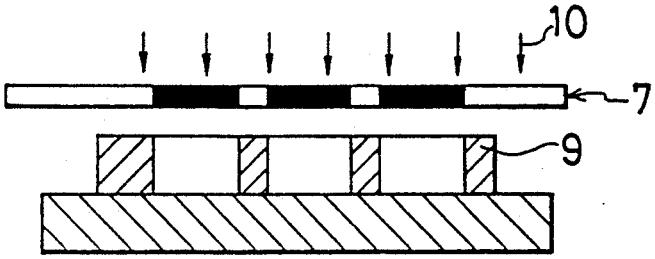
Figure 4C:
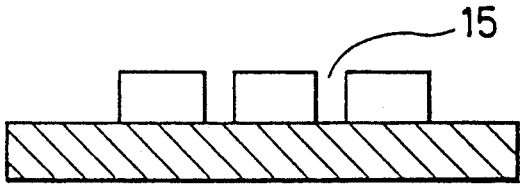
Figure 4D:
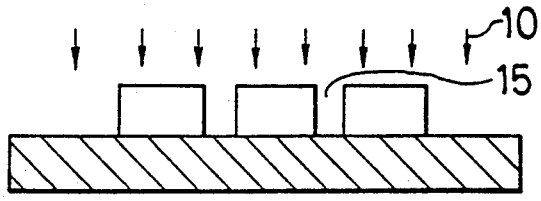
Figure 4E:
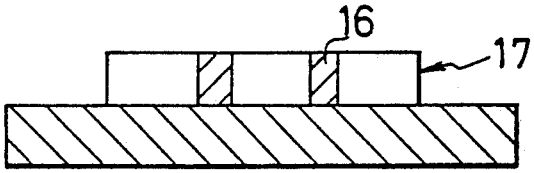
Figure 4F:
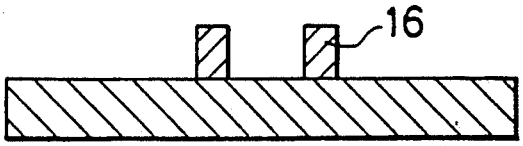
Figure 4G:
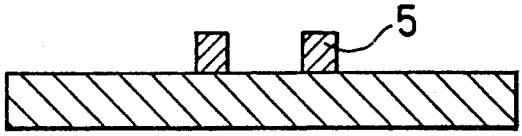
Figure 5A:
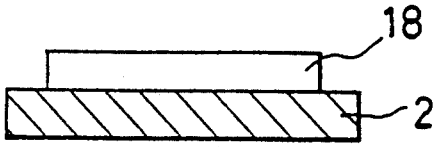
FIGS. 5(*a*)–(*e*) are cross-sectional views illustrating the process for forming electrodes using an ultraviolet-curable resin.
Figure 5B:
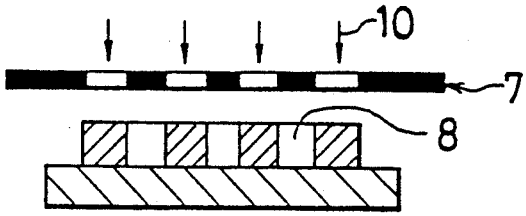
Figure 5C:
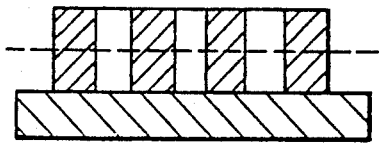
Figure 5D:
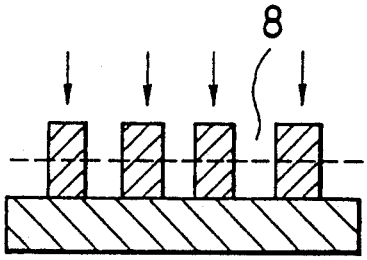
Figure 5E:
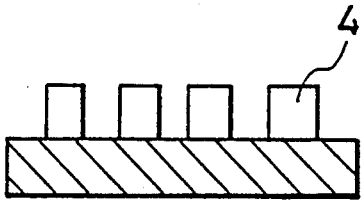
Figure 6A:
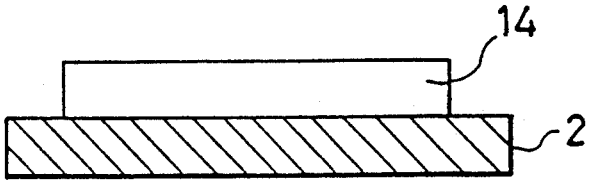
FIGS. 6(*a*)–(*g*) are cross-sectional views illustrating the process for forming electrodes using a positive-type resist.
Figure 6B:
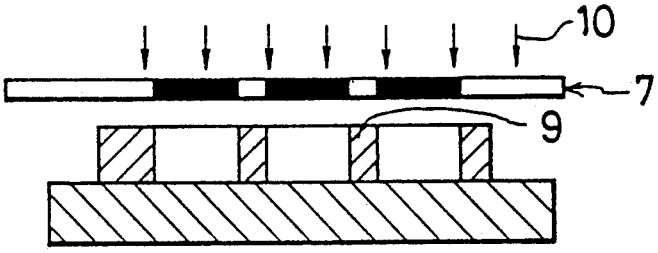
Figure 6C:
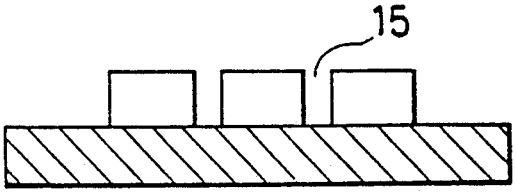
Figure 6D:
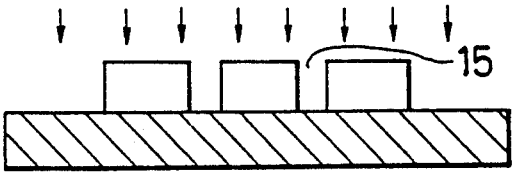
Figure 6E:
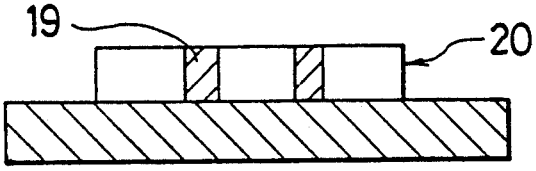
Figure 6F:
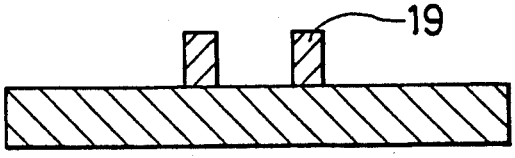
Figure 6G:
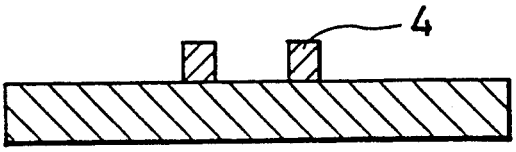

In the present invention, a glass plate is a preferable insulating substrate. It is necessary that the glass plate used should be transmissive to light and have a uniform thickness and usually glass manufactured by a float process can be used. This type of glass may contain $SiO_2$, $Al_2O_3$, $MgO_2$ and CaO as the main ingredients, and $Na_2O$, $K_2O$, PbO, $B_2O_3$ and the like as accessory ingredients.

Generally, electrically conductive metals such as Ni, Cu, Ag and/or Pd or alloys thereof can be used for the cathode electrode materials, but Ni is generally preferable. These metals are used in a mixture with a small amount of glass in a paste form.

Transparent electrodes (ITO electrodes) prepared from evaporated indium oxide and tin oxide may be preferably used as anode electrodes and "ITO" is the abbreviation of indium-tin-oxide.

A black insulating paste capable of being densified by firing at temperatures of 450° to 700° C. is preferably used as the material for forming the barriers. For example, there may be mentioned a paste of ceramic powder consisting of, in weight percentage:

$SiO_2$: 13 to 17%, $Al_2O_3$: 18 to 22%
$Fe_2O_3$: 8 to 12%, $Cr_2O_3$: 2.5 to 3.5%
MnO: 5 to 10%, CaO: 1.5 to 12.5%
PbO: 30 to 40%, $B_2O_3$: 5 to 10%.

The ultraviolet-curable resins used in the present invention are resins which are cured upon being exposed to ultraviolet light and become insoluble in solvents. As such resins, oligomers and polymers with at least one unsaturated bond may be given. Specific examples are polyester acrylate, polyester methacrylate, epoxyacrylate, epoxymethacrylate, polyurethane methacrylate and polyurethane acrylate, etc.

A positive-type resist used in the present invention is subjected to a chemical change when exposed to light and it becomes soluble in an alkali developing solution. Quinone diazide type resins may be used and the AZ type (brand name) photoresist marketed by Hoechst Japan is exemplified. When using the positive-type resist, it may also be mixed with inorganic powder, organic powder, organic solvent and the like to the extent that its light transmission characteristics and photoreactive characteristics are not impaired.

In order to form barriers using an ultraviolet-curable resin in accordance with the present invention, a slip comprising 100 parts by weight of ceramic powder and 20 to 100 parts by weight of an ultraviolet-curable resin is coated onto an insulating substrate by a doctor blade coating method or a roll coating method in which one coating step provides a thickness of 10 to 50 μm. After drying, the part to be cured is exposed to ultraviolet light, such as a high-pressure mercury lamp, while screening the remaining part from the ultraviolet-light exposure using a glass mask, and thereby the exposed part is cured. The drying step is carried out by heating at a temperature of 40° to 100° C. for a period of 1 to 30 minutes. Appropriate exposure conditions are, for example, provided by ultraviolet rays at 360 to 420 nm, with the amount of irradiation ranging from 1400 to 40,000 mJ/cm$^2$. The above steps are repeated once or several times until a desired unfired laminated barrier layer is obtained. The height of the thus formed layer is from 100 to 200 μmm. The laminated barrier layer is developed once to elute the unexposed part while leaving the exposed part. In such a manner, patterning is completed. The subsequent firing step is performed by heating at temperatures of 450° to 700° C. in air or an atmosphere of nitrogen.

If the amount of the ultraviolet-curable resin is less than 20 parts by weight, the exposed, cured portion peels during the patterning operations and patterning becomes impossible. On the other hand, if the amount of the ultraviolet-curable resin is more than 100 parts by weight, swelling occurs during the firing step and formation of barriers are impossible.

In the preparation of a plasma display panel with barriers of different heights, two different masks are used (for a low barrier layer and for a high barrier layer). For example, in the formation of two different kinds of layers, i.e., low layer and high layer, successive operations of coating, drying and exposing to light are repeated using a mask for the low layer and, then, similar successive operations of coating, drying and exposure to light are repeated using a mask for the high layer. Then, the thus laminated layer is developed, and low and high barriers are formed.

When the barriers are formed by a positive-type resist, a positive-type resist is applied onto an insulating substrate, the portions which are to form the barrier pattern are exposed to ultraviolet light. The pattern is developed by eluting the exposed portions to form concave portions. Further, the remaining positive-type resist is rendered soluble in a developing solution by exposing the entire surface to the light. A barrier-forming paste is filled in the concave portions and firing is carried out after eluting the remaining positive-type resist.

In order to form electrodes using an ultraviolet-curable resin, a slip comprising 100 parts by weight of an electrode material and 10 to 100 parts by weight of an ultraviolet-curable resin is coated onto an insulating substrate by a doctor blade coating method or a roll coating method in which one coating provides a thickness of 10 to 50 μmm. The subsequent steps are carried out in the same way as described above for the barrier formation using an ultraviolet-curable resin.

The formation of electrodes by a positive-type resist is performed by the steps of applying a positive-type resist onto an insulating substrate; exposing the portions of the applied resist forming a pattern to ultraviolet-light; developing and eluting the exposed portions to form concave portions; exposing the entire surface to light, thereby rendering the remaining positive-type resist soluble in a developing solution; filling an electrode-forming paste in the concave portions; eluting the remaining positive-type resist; and firing.

The dimensions of the barriers and electrodes formed by an ultraviolet-curable resin or positive-type resist are preferably from 30 to 100 μmm in line width and 0.8 to 1.2 in the ratio of half-width/base width. The limitation of the line width is to provide highly precise detail, and the range of 0.8 to 1.2 for the ratio of the half-width to the base width is to protect the barriers and electrodes. Specifically, if the ratio is less than 0.8, the convex sections of the barriers and electrodes overlap, when the anode substrate and the cathode substrate are matched and stresses are concentrated, thereby causing chipping in the barriers and electrodes. On the other hand, if the ratio exceeds 1.2, cracks may develop between the insulating substrate and the electrodes.

Since the plasma display panel of the present invention have a fine barrier pattern with line widths of not larger than 100 μmm, it permits the formation of finely detailed pictures even if electrodes formed by a usual screen printing process are used.

However, if the electrodes are also formed by the photolithography of the present invention, it is possible to obtain a plasma display panel capable of providing more precise pictures.

EXAMPLES 1 TO 5

FIGS. 2(*a*) to (*e*) are diagrams showing a process for the formation of barriers using an ultraviolet-curable resin A slip was prepared by mixing 20 to 100 parts by weight of an ultraviolet-curable resin, as shown in Table 1, and a solvent, with 100 parts by weight of a black ceramic powder consisting of, in weight percentage, 15% $SiO_2$, 20% $Al_2O_3$, 10% $Fe_2O_3$, 3% $Cr_2O_3$, 7% MnO, 2% CoO, 35% PbO and 8% $B_2O_3$. The ultraviolet-curable resin used was LR-350R manufactured by the Sannopco Ltd. In the present invention, as an ultraviolet-curable resin, a resinous compound prepared by mixing a photo-initiator with a resin component curable by ultraviolet ray in the presence of the photo-initiator may be used. If necessary, various types of additives may be included in the resinous compound. The amounts of ultraviolet-curable resin in the specification are all indicated by the amounts of such a resinous compound.

The solvent used was butyl cellosolve acetate, but ethyl cellosolve and the like are also suitable as solvents.

FIG. 2(*a*) shows that the slip is applied to a glass substrate 1 (front substrate) having anode electrodes thereon and a first coating layer 6 consisting of the ultraviolet-curable resin and the barrier-forming ceramic powder is formed so as to provide a thickness of 10 to 50 μmm after drying. For such coating, either a doctor blade method or a roll coating method can be employed.

In FIG. 2(*b*), ultraviolet light irradiation was carried out using a high pressure mercury lamp to harden the exposed portion 9, while preventing a portion 8 of the first coating layer from being irradiated by using a mask 7. The amount of irradiation is variable according to the type of ultraviolet-curable resin used. As a result, it is sufficient to irradiate until the base of the coating layer 6 is hardened.

Next, as shown in FIG. 2(*c*), the successive steps of coating, drying, and irradiation were repeated to form the second to fifth coating layers with a thickness of 150 to 200 μmm after drying.

The thus formed layer was then developed at the same time, as shown in FIG. 2(*d*), and patterning was completed by eluting the unexposed portion 8.

Thrichloroethane was used as a developing solution and other developing solutions may be selected depending on the type of the ultraviolet-curable resin used.

The patterned glass substrate was heated at a rate of 10° C./min and fired at 580° C. to form a plasma display panel barrier 5 with a thickness of 100 to 120 μmm, as shown in FIG. 2(*e*). The firing temperature varies according to the ceramic powder used and the material of the glass substrate, and any temperature at which the ceramic powder turns black and is sufficiently densified may be used.

The resulting line widths were slightly broader than the line width (opening width for passing ultraviolet ray) of the mask. For example, 100 μmm line widths and 50 μmm line width of the mask provided line widths of 110 μmm and 60 μmm respectively, in the formed patterns. However, the formed barriers have line widths which are about one-half that of the prior art barriers, the minimum line widths of which are 100 μmm. Further, when photolithography techniques are applied to the ceramic powder mixture as in a conventional manner, the aspect ratio (height/width) were limited to about 1/1 or below. However, the present invention permits the formation of patterns having an aspect ratio of at least one.

COMPARATIVE EXAMPLES 1 TO 4

Barriers were formed in the same manner as described in Examples 1 to 5 except that the resin was employed in amounts of less than 20 parts by weight or more than 100 parts by weight with respect to 100 parts by weight of the black ceramic powder. The results are shown in Table 1.

As shown in Table 1, when less than 20 parts by weight of the ultraviolet-curable resin was used relative to the amount of ceramic powder, peeling occurred in the exposed, cured section during the formation of the pattern and the formation of the barrier pattern was impossible. When the relative amount of ultraviolet-curable resin exceeded 100 parts by weight, swelling occurred during firing and the barrier could not be formed. For this reason, 20 to 100 parts by weight of the ultraviolet-curable resin were mixed with 100 parts by weight of the ceramic powder.

TABLE 1

| Examples | Composition (parts by weight) | | Employed Mask (μm) | | Test Results | |
|---|---|---|---|---|---|---|
| | Ceramic Powder for Barrier Formation | Ultraviolet-Curable Resin | 100 | 50 | Pattern | Firing |
| | | | Line Width of Formed Pattern (μm) | | | |
| Comparative Example 1 | 100 | 5 | — | — | No Good | — |
| Comparative Example 2 | 100 | 15 | — | — | No Good | — |
| Example 1 | 100 | 20 | 110 | 60 | Good | Good |
| Example 2 | 100 | 40 | 110 | 60 | Good | Good |
| Example 3 | 100 | 60 | 110 | 60 | Good | Good |
| Example 4 | 100 | 80 | 110 | 60 | Good | Good |
| Example 5 | 100 | 100 | 110 | 60 | Good | Good |
| Comparative Example 3 | 100 | 120 | 110 | 60 | Good | No Good |
| Comparative Example 4 | 100 | 140 | 110 | 60 | Good | No Good |

EXAMPLES 6 TO 8

Barriers were formed in the same manner as described in Examples 1 to 5 except that the amount of the ultraviolet-curable resin was 50 parts by weight with respect to 100 parts by weight of the foregoing barrier-forming black ceramic powder and the line width and line spacing of the mask were changed. The results obtained are given in Table 2.

The formed barrier patterns had a line half-width to base width ratio of 0.9 to 1.0 and a line width (base width) ranging from 30 to 52 μmm.

Each anode substrate having the fine barrier pattern thus formed and a cathode substrate having Ni electrodes formed by a printing process were used to fabricate a plasma display panel. The thus obtained plasma display panel produced excellent clear images as compared with conventional products.

COMPARATIVE EXAMPLES 5 TO 7

Barriers were formed by a printing method using a barrier-forming paste which was made by mixing ethyl cellulose and butyl carbitol acetate with the black ceramic powder used in Example 1. As shown by Comparative Examples 5 and 6 in Table 2, it is impossible to form barriers with a line width of 100 μmm or less. Further, in comparative Example 7, it is possible to form barriers with a line width of 100 μmm or more. However with respect to the shape of the barrier pattern, comparative Example 7 provided a line half-width to base width ratio was about 0.5 and were inferior to Examples 6 to 8 in finess and resolution.

TABLE 2

| Example | Examples of the Present Invention | | | | | | | | | | | | |
|---|---|---|---|---|---|---|---|---|---|---|---|---|---|
| | 6 | | | 7 | | | | | | 8 | | | |
| Methods | Phtolithography (Ultraviolet Curable-Resin) | | | | | | | | | | | | |
| Barrier-Forming Ceramic Powder/ Ultraviolet-Curable Resin | 100/50 | | | 100/50 | | | | | | 100/50 | | | |
| Number of Coatings | 10 | | | 10 | | | | | | 10 | | | |
| Coated Thickness (μm) | 150 | | | 150 | | | | | | 150 | | | |
| Exposure Condition (mJ/cm$^2$) | 39600 | | | 39600 | | | | | | 39600 | | | |
| Employed Mask or Screen | | | | | | | | | | | | | |
| Line Width (μm) | 30 | | | 50 | | | | | | 50 | | | |
| Line Space (μm) | 30 | | | 50 | | | | | | 150 | | | |
| Formed Pattern | | | | | | | | | | | | | |
| Line Half-Width (μm) | 27 | 30 | 29 | 49 | 48 | 51 | 46 | 50 | 50 | 47 | 51 | 52 | 49 |
| Base Width (μm) | 30 | 30 | 30 | 50 | 52 | 49 | 50 | 50 | 50 | 51 | 51 | 51 | 50 |
| Line Space (μm) | 30 | 30 | 30 | 70 | 68 | 71 | 69 | 70 | 150 | 150 | 150 | 150 | 150 |
| Half-Width/Base Width | 0.9 | 1.0 | 1.0 | 1.0 | 0.9 | 1.0 | 0.9 | 1.0 | 1.0 | 1.0 | 1.0 | 1.0 | 1.0 |

| Example | Comparative Examples | | | |
|---|---|---|---|---|
| | 5 | 6 | 7 | |
| Methods | Printing Method | Printing Method | Printing Method | |
| Barrier-Forming Ceramic Powder/ Ultraviolet-Curable Resin | | Barrier-Forming Paste | | |
| Number of Coatings | — | — | — | |
| Coated Thickness (μm) | — | — | — | |
| Exposure Condition (mJ/cm$^2$) | — | — | — | |
| Employed Mask or Screen | | | | |
| Line Width (μm) | 30 | 50 | 52 | 50 |
| Line Space (μm) | 30 | 70 | 150 | 150 |
| Formed Pattern | Printing Impossible | Printing Impossible | 52 | 50 |
| Line Half-Width (μm) | | | | |
| Base Width (μm) | | | 102 | 100 |
| Line Space (μm) | | | 98 | 100 |
| Half-Width/Base Width | | | 0.5 | 0.5 |

EXAMPLE 9

A slip was prepared by mixing 50 parts by weight of an ultraviolet-curable resin LR-350R manufactured by the Sannopco Ltd. with 100 parts by weight of inorganic powder consisting of, in weight percentage, 15% $SiO_2$, 20% $Al_2O_3$, 10% $Fe_2O_3$, 3% $Cr_2O_3$, 7% MnO, 2% CoO, 35% PbO and 8% $B_2O_3$. A suitable amount of n-butyl cellosolve acetate was added as a diluent to adjust the viscosity suitable for coating. This slip was coated on a glass substrate 1 having anode electrodes, as shown in FIG. 3(*a*), and dried to form a coating layer 6. Using a exposure mask 11 for a low layer, with exposure widths of 50 μmm and 30 μmm, and non-exposure widths of 60 μmm and 50 μmm, the coating layer 6 was exposed, as shown in FIG. 3(*b*). The successive operations of coating, drying and exposure were repeated five times to form a cured resin layer of about 100 μmm in height, as shown in FIG. 3(*c*). In addition, after the slip was coated on this low layer and dried, the coating layer was, as shown in FIG. 3(*d*), exposed to light by using a mask 12 for a high layer shown in FIG. 3(*i*), with an exposure width of 50 μm and a non-exposure width of 230 μmm. The successive operations of coating, drying, and exposure were repeated twice to obtain a high cured-resin layer of about 190 μm in height, as shown in FIG. 3(*e*). In this case, the black material used for the low layer was also used for this layer, but, if necessary, white powder different from the low layer could also be used.

These were developed using trichloroethane, and the resin layer of the non-exposed portions 8 was removed to give unfired barriers at the exposed portions 9, as shown in FIG. 3(*f*). These barriers were fired at 580° C. to provide plasma display panel barriers as shown in FIG. 3(*g*) with barriers of different heights of about 110 μmm and about 60 μmm for the respective widths of about 60 μmm and 30 μmm. By applying red, green, and blue fluorescent materials to the sections R, G, and B, respectively, as shown in FIG. 3(*g*), it is possible to obtain a picture element of about 300 μmm, or one-half the size of a conventional picture element, between the ends of two high barriers. In this way, because the lower barriers are used for the separation of the fluorescent materials and the barriers are formed thinly with a small aspect ratio (height/width) and exposed to ultraviolet light, spreading of the resulting barriers is slight with respect to the exposure width of the mask. Also, this panel has a greater discharge time than one which has uniformly high barriers, because the barrier lines are laminated in a low height.

A plasma display panel was fabricated using the thus obtained anode substrate on which the barriers were formed in a fine pattern and a cathode substrate having Ni electrodes formed by a printing process. FIG. 3(*j*) is a perspective view showing the main part of the thus obtained plasma display panel. The display panel is superior in clear images to conventional display panels.

EXAMPLE 10

As shown in FIG. 4(*a*), a 120 μmm thick positive-type resist layer 14 was formed onto a glass substrate having anode electrodes by a doctor blade coating method or roll coating method. The positive-type resist used is, for example, AZ4903 photoresist manufactured by Hoechst Japan. Although the positive-type resist layer 14 of the present invention can be formed only by a positive-type resist, appropriately inorganic powder such as ceramic powder, organic powder, organic solution or the like may be mixed to the extent that light-transmitting property and photoreactive property are not impaired. Therefore, the positive-type resist layer of the present invention means these cases.

FIG. 4(*b*) shows that the above-mentioned positive-type resist is pre-baked and is exposed to ultraviolet light 10 through a mask 7 in such a pattern that exposed portions 9 for the formation of barriers is subjected to the exposure.

FIG. 4(*c*) is a view of the completion of the pattern with opening portions 15 formed in the positive-type resist layer by developing the exposed portions 9 with a developing solution.

FIG. 4(*d*) is a diagram showing the step of exposing the entire surface of the layer with the opening portions 15 to ultraviolet light 10 to make the remaining photoresist portions soluble in a developing solution.

The opening portions 15 of the layer were filled with an insulating paste comprising ceramic powder consisting of, for example, 15% $SiO_2$, 20% $Al_2O_3$, 10% $Fe_2O_3$, 3% $Cr_2O_3$, 7% MnO, 2% CoO, 35% PbO and 8% $B_2O_3$ by weight to form a layer 17 filled with the insulating paste 16. The insulating paste may be any one comprising ceramic powder which becomes a black insulator after firing.

As shown in FIG. 4(*f*), the layer with the above-mentioned opening portions 15 filled with the insulating paste were developed to remove the remaining positive-type resist layer 14 and a pattern of the insulating paste having a thickness of about 80 μmm was formed.

The above-mentioned insulating paste 16 for the formation of barriers was treated at a firing temperature of 580° C. in accordance with a firing process (not shown) employed for thick film paste so that the organic binder was completely burnt away and the glass ceramic material was sintered to form barriers 5. The thus obtained barriers had a line width (base line width) of about 82 to 90 μmm, a height of about 100 μmm and a line half-width to base width ratio of about 0.9 to 1.1. Any temperature at which the insulating paste become black and is sufficiently densified may be sufficient for the firing temperature.

A plasma display panel was fabricated using the thus-obtained anode substrate on which the barriers were formed in a fine pattern and a cathode substrate having Ni electrodes formed by a printing process. The display panel was superior in clearness to conventional display panels.

TABLE 3

| Example | Example 10 |
|---|---|
| Methods | Photolithography (Positive-Type Resist) |

TABLE 3-continued

| Example | Example 10 | | |
|---|---|---|---|
| Number of Coatings | 1 | | |
| Coated Thickness (μm) | 120 | | |
| Exposure Condition (mJ/cm$^2$) | 17820 | | |
| Employed Mask | | | |
| Line Width (μm) | 80 | | |
| Line Space (μm) | 80 | | |
| Formed Pattern | | | |
| Line Half-Width (μm) | 85 | 90 | 96 |
| Base Width (μm) | 90 | 82 | 90 |
| Line Space (μm) | 60 | 76 | 60 |
| Half-Width/Base Width | 0.9 | 1.1 | 1.1 |

EXAMPLES 11 TO 16

FIGS. 5(*a*) to (*e*) are diagrams in explanation of a procedure of forming electrodes of the present invention.

FIG. 5(*a*) is a sectional view illustrating that a slip consisting of 100 parts by weight of a powder mixture for formation of electrodes of Ni powder and borosilicate glass and 10 to 100 parts by weight of ultraviolet-curable resin was applied onto an insulating substrate 2 (back substrate) and dried to form a layer 18 consisting of the electrode-forming powder and the ultraviolet-curable resin.

FIG. 5(*b*) is a schematic diagram showing that the layer 18 consisting of the ultraviolet-curable resin and the electrode-forming powder is exposed to ultraviolet light 10 in such a pattern that areas for the formation of electrodes are irradiated to ultraviolet light 10 through a mask 7.

FIG. 5(*c*) is a sectional view of an electrode layer of the necessary height obtained by repeating the above-mentioned coating, drying, and exposure operations once or several times.

In these Examples, the successive operations were repeated twice to form an electrode layer 30 μmm thick and 50 μmm wide with a line spacing of 100 μmm.

The single or laminated electrode layer was developed at the same time with a developing solution and the unexposed portions 8 were eluted. FIG. 5(*d*) is a diagram showing the remaining portions for electrodes.

The insulating substrate 2 whereon the electrode pattern was formed as outlined above was fired at a temperature of 580° C. so that the organic components were completely burnt away and only the inorganic components remained.

Glass particles as the inorganic component were softened to penetrate into the electrode material and formed extremely densified electrodes 4 (cathode electrodes).

The results are shown in Table 4.

COMPARATIVE EXAMPLES 8 TO 10

Comparative Examples 8 to 10 were carried out in the same procedure as set forth in Examples 11 to 16 except that the mixing ratio of the electrode-forming powder to the ultraviolet-curable resin was changed. The electrode-forming powder means the powder mixture consisting of Ni powder and the glass powder employed in Examples 11 to 16.

When the amount of the ultraviolet-curable resin was less than 10 parts by weight, peeling occurred in the exposed cured portions and no satisfactory electrode pattern was obtained.

When the amount of the ultraviolet-curable resin exceeded 100 parts by weight, swelling occurred during firing and no satisfactory electrode line could be obtained.

These results show that when the above mixing ratio was too less or too much, pattern formation becomes difficult and no satisfactory result can be obtained.

As a result, it has been found that 10 to 100 parts by weight of ultraviolet-curable resin to 100 parts by weight of electrode-forming powder is preferable.

TABLE 4

| Examples | Composition (parts by weight) Electrode-Forming Powder | Ultraviolet-Curable Resin | Employed Mask (μm) 100 Line Width of Formed Pattern (μm) | 50 | Test Results Pattern | Firing |
|---|---|---|---|---|---|---|
| Example 11 | 100 | 10 | 110 | 60 | Good | Good |
| Example 12 | 100 | 20 | 110 | 60 | Good | Good |
| Example 13 | 100 | 40 | 110 | 60 | Good | Good |
| Example 14 | 100 | 60 | 110 | 60 | Good | Good |
| Example 15 | 100 | 80 | 110 | 60 | Good | Good |
| Example 16 | 100 | 100 | 110 | 60 | Good | Good |
| Comparative Example 8 | 100 | 5 | — | — | No Good | — |
| Comparative Example 9 | 100 | 120 | 110 | 60 | Good | No Good |
| Comparative Example 10 | 100 | 140 | 110 | 60 | Good | No Good |

EXAMPLES 17 TO 19

Electrodes were formed in the same manner as set forth in Examples 11 to 16 except that the mixing ratio (in parts by weight) of the electrode-forming powder to the ultraviolet-curable resin was 100/50. The results are shown in Table 5.

The method of the present invention is advantageous in the formation of a fine pattern as compared with the conventional screen printing method. The patterns according to the present invention had a ratio of the half-width to the base width of 0.9 to 1.0, which is larger than the ratio of 0.5 obtained in the case of the screen printing method.

Plasma display panels were fabricated using the thus obtained cathode substrates and the anode substrates on which the barriers were formed by photolithography as described in Examples 6 to 8. The display panels were superior to clearness to conventional display panels.

COMPARATIVE EXAMPLES 11 TO 13

Electrode formation was tried by conventional screen printing method. As shown in Comparative Examples 11 and 12, it is difficult to form electrodes with a line width 100 μm or less. Further, in Comparative Example 13, it is possible to form electrodes with a line width of 100 μm or greater. The ratio of the line half-width to the base width is about 0.5 and it is clear that the comparative example is inferior in precision and resolution to Examples 17 to 19. The Ni paste used for the formation of the electrodes was Ni paste ESL #2554 (trade name).

TABLE 5

| Examples | Examples of the Present Invention 17 | | | 18 | | | | | | 19 | | | |
|---|---|---|---|---|---|---|---|---|---|---|---|---|---|
| Methods | Photolithography (Ultraviolet-Curable Resin) | | | | | | | | | | | | |
| Electrode-Forming Powder/ Ultraviolet-Curable Resin | 100/50 | | | 100/50 | | | | | | 100/50 | | | |
| Number of Coatings | 2 | | | 2 | | | | | | 2 | | | |
| Coated Thickness (μm) | 30 | | | 30 | | | | | | 30 | | | |
| Exposure Condition (mJ/cm²) | 7920 | | | 7920 | | | | | | 7920 | | | |
| Employed Mask or Screen | | | | | | | | | | | | | |
| Line Width (μm) | 30 | | | 50 | | | | | | 50 | | | |
| Line Space (μm) | 30 | | | 70 | | | | | | 150 | | | |
| Formed Pattern | | | | | | | | | | | | | |
| Line Half-Width (μm) | 27 | 30 | 29 | 49 | 48 | 51 | 46 | 50 | 50 | 47 | 51 | 52 | 49 |
| Base Width (μm) | 30 | 30 | 30 | 50 | 52 | 49 | 50 | 50 | 50 | 51 | 51 | 51 | 50 |
| Line Space (μm) | 30 | 30 | 30 | 70 | 68 | 71 | 69 | 70 | 150 | 150 | 149 | 150 | 150 |
| Half-Width/Base Width | 0.9 | 1.0 | 1.0 | 1.0 | 0.9 | 1.0 | 0.9 | 1.0 | 1.0 | 1.0 | 1.0 | 1.0 | 1.0 |

| Example | Comparative Examples 11 | 12 | 13 | |
|---|---|---|---|---|
| Methods | Printing Method Ni Paste | Printing Method Ni Paste | Printing Method Ni Paste | |
| Electrode-Forming Powder/ Ultraviolet-Curable Resin | | | | |
| Number of Coatings | — | — | — | |
| Coated Thickness (μm) | — | — | — | |
| Exposure Condition (mJ/cm²) | — | — | — | |
| Employed Mask or Screen | | | | |
| Line Width (μm) | 30 | 50 | 52 | 50 |

TABLE 5-continued

| | | | | |
|---|---|---|---|---|
| Line Space (μm) | 30 | 70 | 150 | 150 |
| Formed Pattern | | | | |
| Line Half-Width (μm) | Printing Impossible | Printing Impossible | 52 | 50 |
| Base Width (μm) | | | 102 | 100 |
| Line Space (μm) | | | 98 | 100 |
| Half-Width/Base Width | | | 0.5 | 0.5 |

EXAMPLE 20

FIGS. 6(*a*)–(*g*) are diagrams showing the process for the formation of electrodes using a positive-type resist according to the present invention.

FIG. 6(*a*) is a perspective view of the formation of a positive-type resist layer 14 with a thickness of 30 μm onto an insulating substrate 2 by roll coating. "AZ 4903" (trade name) was used as positive-type resist.

The positive-type resist layer was prebaked and portions for the formation of electrodes were exposed to ultraviolet light 10 through a mask 7. FIG. 6(*b*) is a diagram showing the selective exposure to ultraviolet light.

FIG. 6(*c*) is a sectional view of a pattern of the positive-type resist layer with opening portions 15 formed by developing the exposed portions 9 with a developing solution.

FIG. 6(*d*) is a diagram showing the step of exposing the entire surface of the layer with the opening portions 15 to ultraviolet light to make the rest of the positive-type photoresist soluble in the developing solution.

The above-mentioned layer with the opening portions 15 were filled with an electrode paste 19, such as ESL #2554 which is a nickel paste manufactured by the ESL Company. FIG. 6(*e*) is a sectional view of the thus formed layer 20 filled with the electrode paste 19.

FIG. 6(*f*) is a sectional view of the layer with a pattern of the electrode paste 19 which is formed by developing the layer with the opening portions 15 filled with the electrode paste 19 and then removing the remaining positive-type resist with the developing solution, FIG. 6(*g*) is a sectional view showing that the electrode pattern of the electrode paste 19 is fired at about 580° C. so that the organic components are completely burnt away and only the inorganic components remain to form electrodes 4.

The glass particles of the inorganic component were softened to penetrate into interstices between the nickel particles and formed a nickel electrode pattern. In such a manner, there were formed electrodes having a line width of 48 to 50 μmm and a line spacing of 70 to 78 μmm. The formed pattern had a line half-width to base width ratio of 0.9 to 1.0. The results are shown in Table 6.

TABLE 6

| Examples | 20 | | |
|---|---|---|---|
| Methods | Photolithography (Positive-Type Resist) | | |
| Powder for Electrode/Resin | 100/50 | | |
| Number of Coatings | 1 | | |
| Coated Thickness (μm) | 30 | | |
| Exposure Condition (mJ/cm$^2$) | 3960 | | |
| Employed Mask | | | |
| Line Width (μm) | 50 | | |
| Line Space (μm) | 70 | | |
| Formed Pattern | | | |
| Line Half-Width (μm) | 48 | 50 | 50 |
| Base Width (μm) | 46 | 50 | 50 |
| Line Space (μm) | 78 | 70 | 70 |

TABLE 6-continued

| Examples | 20 | | |
|---|---|---|---|
| Half-Width/Base Width | 1.0 | 1.0 | 0.9 |

Plasma display panels were fabricated using the cathode substrates obtained as described above and the anode substrates having the fine barrier patterns obtained in Examples 6 to 8 and 10. The obtained plasma display panels were very superior in visibility.

What is claimed is:

1. In a process for producing a plasma display panel comprising a pair of insulating substrates with a predetermined space therebetween; a group of anode electrodes and a group of cathode electrodes formed on an inner side of each of said insulating substrates in such a manner that said groups of anode and cathode electrodes are normal to each other; and barriers formed on said insulating substrate which has said anode electrodes formed thereon, the improvement comprising said barriers being formed by a photolithography process using an ultraviolet-curable resin comprising the steps of:

(1) applying a slip comprising an ultraviolet-curable resin and ceramic powder for forming said barrier onto said insulating substrate or said insulating substrate having said electrodes, thereby forming a coating layer;

(2) exposing portions of said coating layer to ultraviolet light through a mask in such a pattern as to correspond to a pattern of said barriers, thereby curing said ultraviolet-curable resin;

(3) repeating steps (1) and (2) at least once and until the thickness of said coating layer reaches the desired thickness;

(4) developing the exposed portions of said coating layer and removing the unexposed portions to form said pattern of said barriers; and (5) firing said exposed portions to form said barriers, whereby the developing and firing steps are not performed until the coating has reached the desired thickness.

2. In a process for producing a plasma display panel comprising a pair of insulating substrates with a predetermined space therebetween; a group of anode electrodes and a group of cathode electrodes formed on an inner side of each of said insulating substrates in such a manner that said groups of anode and cathode electrodes are normal to each other; and barriers formed on said insulating substrate which has said anode electrodes formed thereon, the improvement comprising said cathode electrodes being formed by a photolithography process using an ultraviolet-curable resin comprising the steps of:

(1) applying a conductive paste comprising an ultraviolet-curable resin and metal powder for forming said electrodes onto said insulating substrate, thereby forming a coating layer;

(2) exposing said coating layer to ultraviolet light through a mask in such a pattern as to correspond to a pattern of said electrodes;
(3) repeating steps (1) and 2) at least once and until the thickness of said coating layer reaches the desired thickness;
(4) developing the exposed portions of said coating layer and removing the unexposed portions to thereby form said pattern of said electrodes; and
(5) firing said exposed portions to form said electrodes, whereby the developing and firing steps are not performed until the coating layer has reached the desired thickness.

3. In a process for producing a plasma display panel comprising a pair of insulating substrates with a predetermined space therebetween; a group of anode electrodes and a group of cathode electrodes formed on an inner side of each of said insulating substrates in such a manner that said groups of anode and cathode electrodes are normal to each other; and barriers formed on said insulating substrate which has said anode electrodes formed thereon, the ratio of the half-width (line width at the half-height) to the base width of said barriers being in the range of 0.8 to 1.2, the improvement comprising said barriers being formed by a photolithography process using a positive-type resist comprising the steps of:
(1) forming a positive-type resist layer having a thickness equal to or greater than the thickness of said barriers to be formed on said insulating substrate on said insulating substrate having said electrodes;
(2) exposing portions of said positive-type resist layer to ultraviolet light through a mask in such a pattern as to correspond to a pattern of said barriers;
(3) developing and eluting the exposed portions of said resist layer to form opening portions corresponding to the pattern of said barriers;
(4) exposing the remaining portions of the resist layer to ultraviolet light to make said remaining portions soluble in a developing solution;
(5) filling an insulating paste comprising ceramic powder for forming said barriers in the opening portions;
(6) eluting said remaining portions of said resist layer with a developing solution; and
(7) firing said insulating paste to form said barriers; and wherein said cathode electrodes are formed by a photolithography process using an ultraviolet-curable resin, said cathode electrode forming process comprising the steps of:
(1) applying a conductive paste comprising an ultraviolet-curable resin and metal powder for forming said electrodes onto said insulating substrate, thereby forming a coating layer;
(2) exposing said coating layer to ultraviolet light through a mask in such a pattern as to correspond to a pattern of said electrodes;
(3) repeating steps (1) and (2) until the thickness of said coating layer becomes the desired thickness;
(4) developing the exposed portions of said coating layer and removing the unexposed portions to thereby form said pattern of said electrodes; and
(5) firing said exposed portions to form said electrodes, whereby the developing and firing steps are not performed until the coating layer has reached the desired thickness.

4. The process as claimed in claim 3, wherein said conductive paste comprises 10–100 parts by weight of said ultraviolet-curable resin per 100 parts by weight of metal powder.

5. A process as claimed in claim 1, wherein the ratio of the half-width (line width at the half-height) to the base width of said barriers is in the range of 0.8 to 1.2.

6. A process as claimed in claim 5, wherein said cathode electrodes are formed by a printing process.

7. A process as claimed in claim 5, wherein said cathode electrodes are formed by a photolithography process using an ultraviolet-curable resin, said process comprising the steps of:
(1) applying a conductive paste comprising an ultraviolet-curable resin and metal powder for forming said electrodes onto said insulating substrate, thereby forming a coating layer;
(2) exposing said coating layer to ultraviolet light through a mask in such a pattern as to correspond to a pattern of said electrodes;
(3) repeating steps (1) and (2) at least once and until the thickness of said coating layer becomes the desired thickness;
(4) developing the exposed portions of said coating layer and removing the unexposed portions to thereby form said pattern of said electrodes; and
(5) firing said exposed portions to form said electrodes, whereby the developing and firing steps are not performed until the coating layer has reached the desired thickness.

8. A process as claimed in claim 5, wherein said cathode electrodes are formed by a photolithography process using a positive-type resist, said process comprising the steps of:
(1) forming a positive-type resist layer having a thickness equal to or greater than the thickness of said electrodes to be formed on said insulating substrate;
(2) exposing said positive-type resist layer to ultraviolet light through a mask in such a pattern as to correspond to a pattern of said electrodes;
(3) developing and eluting the exposed portions of said resist layer to form opening portions corresponding to said pattern of said electrodes;
(4) exposing the remaining portions of the resist layer to ultraviolet light to make said remaining portions soluble in a developing solution;
(5) filling a conductive paste comprising metal powder for forming said electrodes in the opening portions;
(6) eluting said remaining portions with a developing solution; and
(7) firing said conductive paste for form said electrodes.

9. A process as claimed in claim 5, wherein said barriers are different in height.

10. A process as claimed in claim 9, wherein said cathode electrodes are formed by a printing process.

11. A process as claimed in claim 9, wherein said cathode electrodes are formed by a photolithography process using an ultraviolet-curable resin, said process comprising the steps of:
(1) applying a conductive paste comprising an ultraviolet-curable resin and metal powder for forming said electrodes onto said insulating substrate, thereby forming a coating layer;
(2) exposing said coating layer to ultraviolet light through a mask in such a pattern as to correspond to a pattern of said electrodes;

(3) repeating steps (1) and (2) at least once and until the thickness of said coating layer becomes the desired thickness;

(4) developing the exposed portions of said coating layer and removing the unexposed portion to thereby form said pattern of said electrodes; and (5) firing said exposed portions to form said electrodes, whereby the developing and firing steps are not performed until the coating layer has reached the desired thickness.

12. A process as claimed in claim 9, wherein said cathode electrodes are formed by a photolithography process using a positive-type resist, said process comprising the steps of:

(1) forming a positive-type resist layer having a thickness equal to or greater than the thickness of said electrodes to be formed on said insulating substrate;

(2) exposing said positive-type resist layer to ultraviolet light through a mask in such a pattern as to correspond to a pattern of said electrodes;

(3) developing and eluting the exposed portions of said resist layer to form opening portions corresponding to said pattern of said electrodes;

(4) exposing the remaining portions of the resist layer to ultraviolet light to make said remaining portions soluble in a developing solution;

(5) filling a conductive paste comprising metal powder for forming said electrodes in the opening portions;

(6) eluting said remaining portions with a developing solution; and (7) firing said conductive paste for form said electrodes.

13. The process as claimed in claim 1, wherein said slip comprises from 20 to 100 parts by weight of said ultraviolet-curable resin per 100 parts by weight of ceramic powder.

14. The process as claimed in claim 7, wherein said conductive paste comprises from 10–100 parts by weight of said ultraviolet-curable resin per 100 parts by weight of metal powder.

15. The process as claimed in claim 11, wherein said conductive paste comprises 10–100 parts by weight of said ultraviolet-curable resin per 100 parts by weight of metal powder.

* * * * *

UNITED STATES PATENT AND TRADEMARK OFFICE

CERTIFICATE OF CORRECTION

PATENT NO. : 5 209 688

DATED : May 11, 1993

INVENTOR(S) : Susumu NISHIGAKI et al

It is certified that error appears in the above-identified patent and that said Letters Patent is hereby corrected as shown below:

In the drawings, Sheet 1 of 8; Figure 1 should appear as follows:

FIG.1

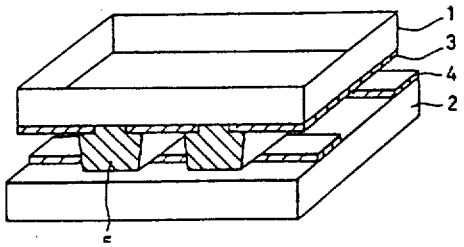

Column 17, line 4; change "and 2)" to ---and (2)---.

Column 20, line 12; change "for" to ---to---.

Signed and Sealed this

Twenty-ninth Day of March, 1994

*Attest:*

*Attesting Officer*

BRUCE LEHMAN

*Commissioner of Patents and Trademarks*